US009254555B2

(12) United States Patent
Hagan et al.

(10) Patent No.: US 9,254,555 B2
(45) **Date of Patent: *Feb. 9, 2016**

(54) CLAMPING DEVICE WITH REMOVABLE HANDLES

(71) Applicant: Delaware Capital Formation, Inc., Wilmington, DE (US)

(72) Inventors: Kenneth Hagan, Eastpointe, MI (US); David Martin, Dearborn, MI (US); Henry Dykstra, Richmond, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/272,998

(22) Filed: May 8, 2014

(65) Prior Publication Data

US 2014/0230198 A1 Aug. 21, 2014

Related U.S. Application Data

(63) Continuation of application No. 12/690,183, filed on Jan. 20, 2010, now Pat. No. 8,740,208.

(51) Int. Cl.

| | |
|---|---|
| ***B25B 5/04*** | (2006.01) |
| ***B25B 5/06*** | (2006.01) |
| ***B25B 5/12*** | (2006.01) |
| ***B25B 5/16*** | (2006.01) |
| ***B25B 1/04*** | (2006.01) |

(52) U.S. Cl.

CPC ... *B25B 5/06* (2013.01); *B25B 1/04* (2013.01); *B25B 5/04* (2013.01); *B25B 5/12* (2013.01); *B25B 5/16* (2013.01); *Y10T 24/44009* (2015.01)

(58) Field of Classification Search

None

See application file for complete search history.

(56) References Cited

U.S. PATENT DOCUMENTS

| | | | | |
|---|---|---|---|---|
| 3,807,718 | A | 4/1974 | Sendoykas | |
| 4,354,628 | A | 10/1982 | Green | |
| 4,728,137 | A | 3/1988 | Hamed et al. | |
| 5,014,578 | A * | 5/1991 | Flentge | 81/367 |
| 5,116,349 | A | 5/1992 | Aranyi | |
| 5,161,787 | A | 11/1992 | Hobday | |
| 5,527,024 | A * | 6/1996 | Dysktra | 269/94 |
| 6,386,532 | B1 | 5/2002 | Donovan et al. | |
| 6,474,130 | B2 | 11/2002 | Battenfeld | |
| 6,551,316 | B1 | 4/2003 | Rinner et al. | |
| 6,655,670 | B1 | 12/2003 | Liou | |
| 6,983,506 | B1 | 1/2006 | Brown | |
| 7,267,606 | B2 | 9/2007 | Hsieh | |
| 8,561,973 | B2 * | 10/2013 | Martin | 269/6 |
| 2008/0072716 | A1 | 3/2008 | Chen | |
| 2008/0277849 | A1 | 11/2008 | Phillips, Sr. et al. | |
| 2009/0007733 | A1 | 1/2009 | Robinson et al. | |
| 2009/0014934 | A1 | 1/2009 | Seber | |
| 2009/0199682 | A1 | 8/2009 | Hanning et al. | |
| 2011/0175270 | A1 | 7/2011 | Hagan et al. | |

* cited by examiner

*Primary Examiner* — Elizabeth A Plummer

(74) *Attorney, Agent, or Firm* — Harness, Dickey & Pierce, P.L.C.

(57) ABSTRACT

A clamping device has a removable handle to move a clamp between an opened and clamped position. A receiving member is on the clamp to receive the handle. The handle has a latching member to couple with the receiving member. An actuating member is coupled with the handle to move the clamp from an opened to clamped position. A release mechanism is coupled with the clamp or handle to move the clamp from a clamped to an opened position.

8 Claims, 8 Drawing Sheets

CLAMPING DEVICE WITH REMOVABLE HANDLES

CROSS-REFERENCE TO RELATED APPLICATION

This application is a continuation of U.S. patent application Ser. No. 12/690,183, filed on Jan. 20, 2010. The entire disclosure of the above application is incorporated herein by reference.

FIELD

The present disclosure relates to clamping and, more particularly, to a clamping device with a removable handle.

BACKGROUND

When clamping workpieces with manual clamps, ordinarily the clamps have handles that extend from the workpiece. The user is required to be around the clamped workpiece conducting other operations. Since the handles project beyond the workpiece, the handles are constantly in the way of the user as he moves about the workpiece. Ordinarily, the handles are bumped or nudge, requiring realignment of the clamping device. In some instances, the clamp may be bumped so that it is removed from the workpiece, causing additional work to be conducted onto the workpiece.

However, the handles are an important part to the clamps. The handles provide leverage to open the clamp so that the clamps may apply a greater force onto the workpiece. The longer the handles, the less force required to open the clamps and generally the larger the force applied by the clamps onto the workpiece.

Accordingly, while handled clamps serve a vital purpose, it is desirable to move the handles out of the way so that the handles are not bumped, contacted, or otherwise interfered with by the user while the user works around the clamped workpiece.

According to the present disclosure, a clamping system is provided that overcomes the deficiencies of the present handled clamping devices. The present disclosure provides a clamp with a removable handle. The handle enables the clamp to be applied to the workpiece. The handle is then removed from the clamp so that the handles do not interfere with the user or other materials during further manipulation of the workpiece. The disclosure provides a single handle that may be utilized with a plurality of clamps to be secured onto a workpiece.

SUMMARY

According to a first aspect of the disclosure, a clamping device with a removable handle comprises a clamp with a mechanism to move the clamp between an opened and clamped position. A receiving member is coupled with the clamp to receive a handle. A removable handle includes a latching member to couple with the receiving member of the clamp. An actuating member is coupled with the handle. The actuating member operatively associated with the mechanism to move the clamp such that upon activation of the actuating member, the actuating member moves the clamp from an opened to a clamped position. A release member is coupled with the clamp or the handle to operatively couple with the mechanism to move the clamp from a clamped to an opened position. The mechanism moving the clamp is a toggle device that includes a pivot and pairs of plates. The plates are connected between opposing arms of the clamp and the pivot. The toggle device moves the arms between an opened and clamped position. The handle actuating member further includes a movable surface that abuts the toggle device to move the clamp between the opened and clamped position. The surface moves along an axial or arcuate path. The receiving member includes an element projecting from the clamp. The latch includes a slot in the handle to removably secure with the pin. The release mechanism further includes a lever associated with one of the plates to move the clamp from the clamped position to the opened position.

Accordingly to a second aspect of the disclosure, a clamping device with a removable handle comprises a C-clamp including a pair of arms connected with one another by a toggle mechanism. The toggle mechanism moves the arms between an opened and clamped position. A receiving pin projects from the C-clamp to receive a removable handle. A removable handle removably couples with the receiving pin. The handle moves the arms from the opened to the clamped position. The handle includes a housing. A latch is coupled with the housing to couple the housing with the receiving pin. The latch is movable between a coupled position, secured with the receiving pin, and a released position, enabling removal of the housing from the receiving pin. A toggle activating member is coupled with the housing. The toggle activating member is movable in the housing to engage the toggle mechanism and move the arms into the clamped position. A release element is coupled with the C-clamp to engage the toggle mechanism. The release mechanism moves the arms into the opened position. The arms include a rear tab that forms a cut-out to receive plates from the toggle mechanism to form an overcenter locking arrangement. The toggle activating member includes a roller connected to a lever in the handle housing. The roller engages the toggle mechanism. The handle housing includes a track to guide the roller into contact with the toggle mechanism.

In accordance with a third aspect of the present disclosure, the clamp comprises a pair of arms having two ends, one end of each arm is connected together by a pivot mechanism. The pivot mechanism enables the arms to move between an opened and a clamped position. A receiving member for receiving a handle is on at least one of the arms. A handle removably couples with the receiving member. The handle includes an activating mechanism to engage the pivot mechanism to move the arms between the opened and clamped position. A release mechanism is coupled with the pivot mechanism to move the arms between the clamped position and the open position. The activation member includes a surface to contact the pivot mechanism to move the arms between the opened and clamped position. The receiving member includes a pin projecting from both sides of the arms. The handle includes a pair of latches to removably couple with the pins on both sides of the arms. The handle is removed from the arms after the arms are moved into the clamped position. A plurality of arms and pivot mechanism form a plurality of clamps.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
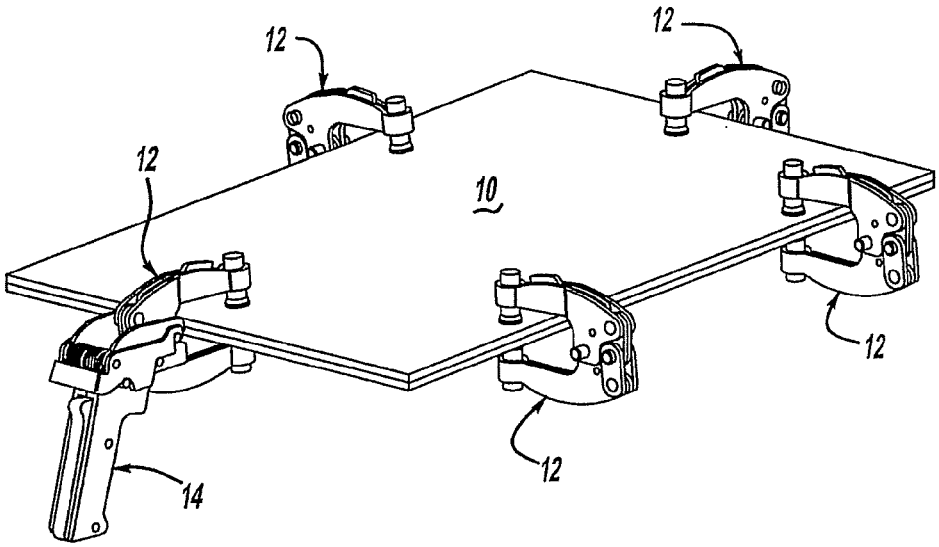
FIG. 1 is a perspective view of a plurality of clamps with a removable handle.

Turning to the figures, FIG. 1 illustrates a workpiece 10 including a plurality of C-clamps 12 with one of the C-clamps 12 including a removable handle 14.

Figure 2:
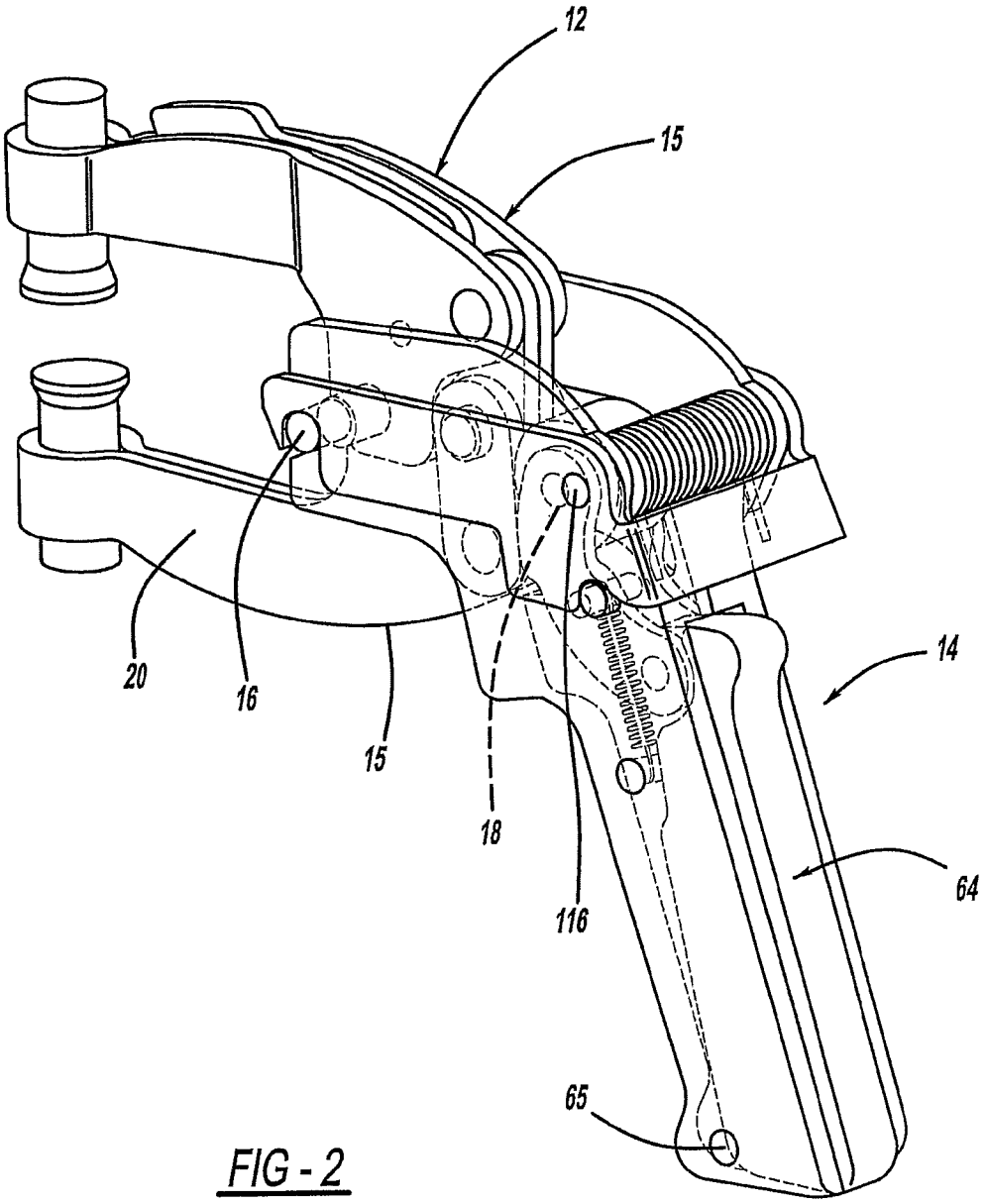
FIG. 2 is a perspective view of the clamp with a removable handle.

Turning to the figures, specifically FIG. 2, the clamps 12 include a pair of arms 15, 15' secured with one another by a pin 16. A toggle mechanism 18 moves the arms 15, 15' between an opened and clamped position.

The arms 15, 15' are substantially identical. Each arm 15, 15' has an overall T-shape when viewed in side elevation. The horizontal portion 20 includes a loop 22 at one end and an aperture 24 at the other. The vertical component 26 is offset towards the aperture 24. The vertical component 26 also includes an aperture 28. The loop 22 enables the arm 15 to fold upon itself so that the arm 15 is bifurcated having two identical side panels creating a gap 29 between the adjacent side panels. A pressing member 31 or the like can be positioned into the loop so that it may apply a force onto the workpiece.

Figure 4:
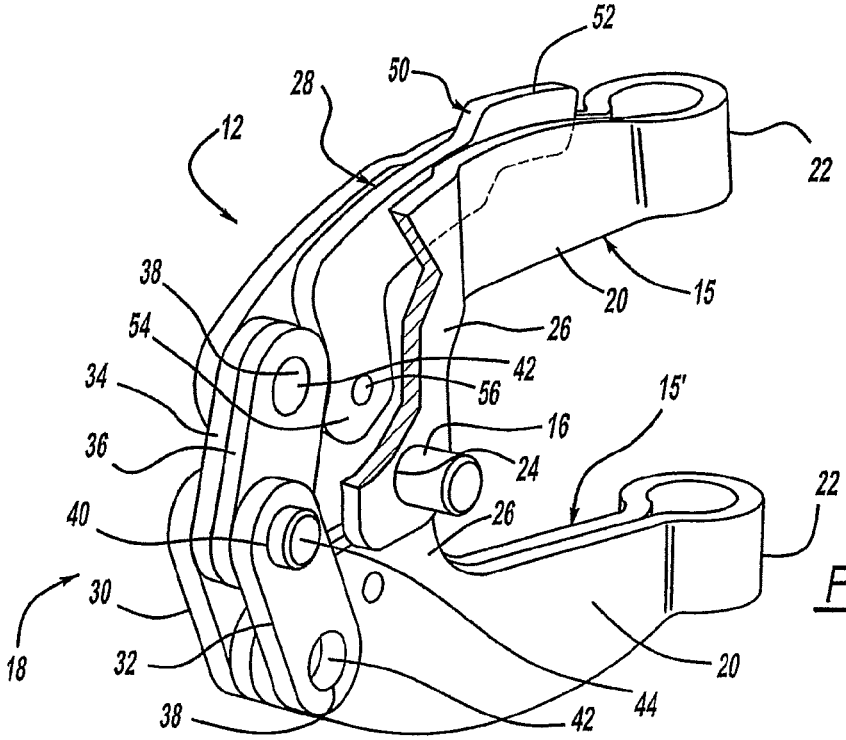
FIG. 4 is a perspective view of a clamp with a cutaway portion in an open condition.

The arm 15' has the same overall shape as the arm 15 including the loop and apertures. However, the bifurcated portions are positioned adjacent to one another so that a gap is eliminated as seen in FIG. 4.

Accordingly, the apertured end of the vertical component 26 of the arm 15' is positioned into the gap 29 so that pin 16 may pass through both arms 15 and 15'. The pin 16 projects from both sides of the side panels of the arm 15 to form receiving pins for the removable handle 14.

The toggle mechanism 18 includes a first pair of outer plates 30 and 32 and a second pair of inner plates 34 and 36. The plates 30-36 are substantially identical. The plates 30-36 include apertures 38 and 40 at each end. The apertures 38 receive a pin 42 that secures the end with the arms 15 and 15'. The pin 42 also passes through the aperture 28 in the arms 15 and 15'. The pin 44 passes through apertures 40 connecting the other ends of the plates 30-36 with one another. The ends of the plates captured by the pin 44 fit into a cut-out portion 37 in the arms 15 and 15'. The cut-out portion 37 receives the end of the plates so that the plates 30-36, when the toggle mechanism 18 is in a locked condition, are received in the cut-outs 37 to provide an overcenter locking arrangement for the clamps 12.

A release mechanism 50 is maintained in the gap 28 between the bifurcated side panel of arm 15. The release mechanism 50 has an overall L-shape with a button 52 and a tab 54. An aperture 56 is formed in the release mechanism 50 to enable a pin to pass through the aperture 56 and arm aperture 58 to maintain the release mechanism 50 in the gap 29. As button 52 is pushed downward, so that it moves into the gap 29 between the side panels 20, the tab 54 pushes outwardly against one of the plates 34, 36. This moves the plates 30-36 out of the overcenter arrangement position releasing the clamping mechanism from a clamped position as seen in FIG. 4.

Figure 3:
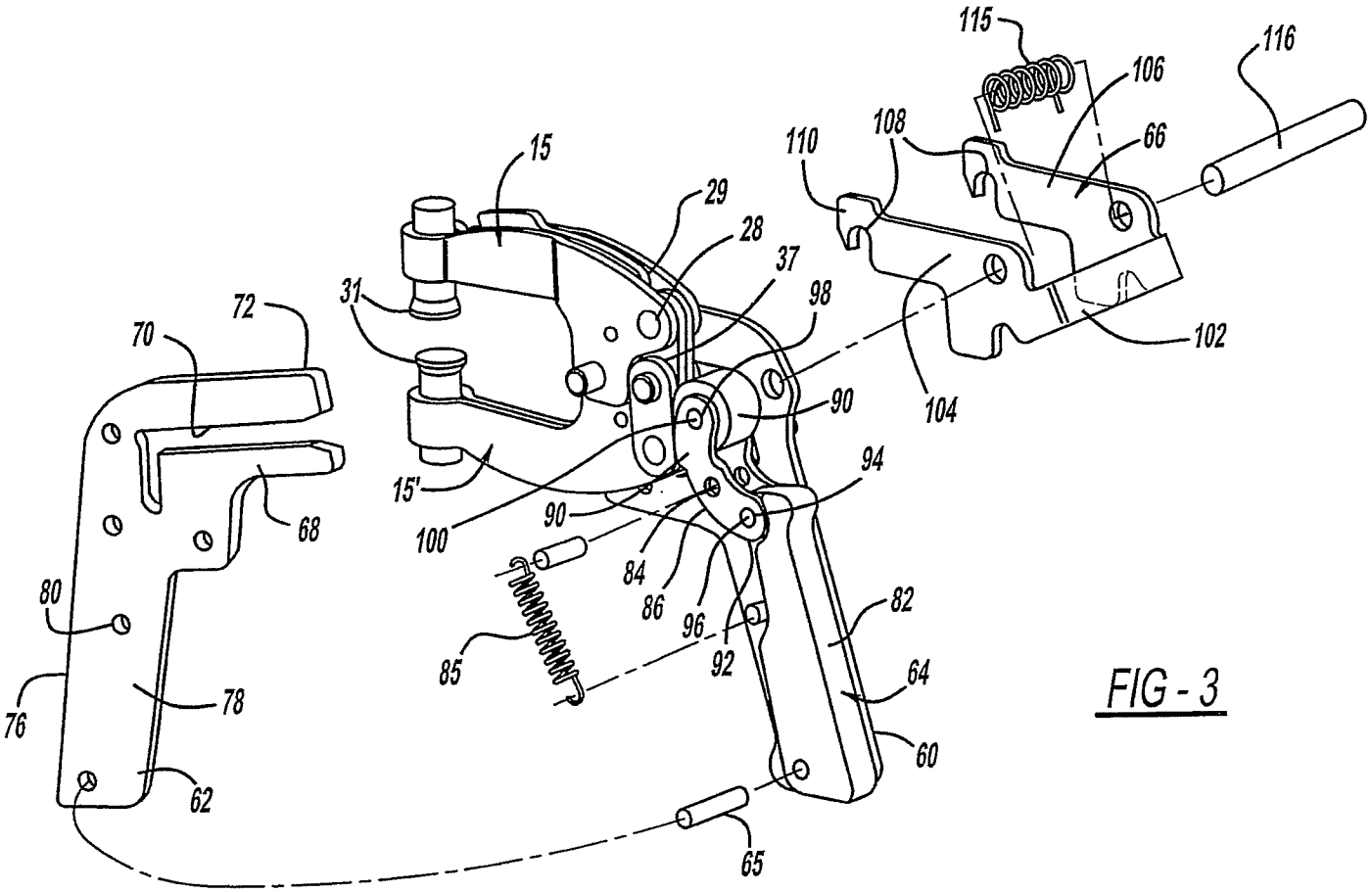
FIG. 3 is a partial exploded perspective view of the handle of FIG. 2.

Turning to the handle 14 as best seen in FIG. 3, the handle 14 includes a pair of housing members 60 and 62. The housing members 60 and 62 are mirror images of one another and the description of one will apply to both. The housing members 60 and 62 form a cavity to receive an activation member 64. Additionally, a latch mechanism 66 is coupled with the housing members 60 and 62 to removably secure the handle 14 with the receiving pin 16.

The housing member 60 and 62 has an overall L-shape. The short leg 68 includes a slot 70 that receives a portion of the actuating mechanism 64 as will be discussed herein. The slot 70 is L-shaped and is open through the end of the short leg 68. A cover 72 is positioned on the outside of the short leg 68 to form a cavity 74 between the short leg 68 and the cover 72. The cavity 74 enables movement of the latch mechanism 66 as will be described herein. The long leg 76 includes a sidewall 78 that defines the cavity 80 that receives the actuating mechanism 64. When the housing member 60 and 62 are positioned together, the cavity 80 receives the actuation member 64. A pin 65 is positioned through the housing members 60 and 62 as well as the actuating member 64 so that the actuating member 64 pivots in the cavity 80.

The actuating member 64 includes a lever 82, arcuate side members 84 and 86, as well as a roller 90 pinned between the arcuate side members 84 and 86. The lever 82 is secured with the housing 60 and 62 at the bottom of the housing by pin 65. The other end of the lever includes a cut-out 92 that receive an end of the arcuate side members 84 and 86. The arcuate side members 84 and 86 include an aperture 94 that receives a pin 96 that secures the arcuate side members 84 and 86 in the cut-out 92 to the lever 82. The other end of the arcuate members 84 and 86 also includes an aperture 98 that receives a pin 100 that secures the ends of the arcuate side members 84 and 86 to the roller 90. A spring 85 is connected between the side members 84 and 86 and an aperture 87 of the housing 62. The spring 85 applies a force on lever 82 to maintain lever 82 in a normally outward position to enable the clamp 12 to be in an unclamped position.

The latch 66 includes a web portion 102 connecting a pair of legs 104 and 106. Each leg 104 and 106 includes a cut-out 108 defining a hook member 110 that captures the pin 16 to retain the handle 14 onto the clamp 12. The latch legs 104 and 106 pivot about pin 116 to move within the cavities 74 defined by the cover 72 and the short leg 68. Thus, the latch legs 104, 106 can move up and down in the housing to capture and release the pin 16.

In operation, the latch 66 web portion 102 is pressed downward which, in turn, rotates the legs 104 and 106 upward so that the hook member 110 clears the pin 16 on the clamp 12. A torsion spring 115 is mounted around pin 116 between legs 104 and 106. The spring 115 generally applies a torsional force onto the web portion 102 to maintain it away from the handle 14. Force is released from the web portion 102 which enables the pin 16 to be captured in the cut-out 108 of the hook member 110 of the latch 66. As this occurs, the handle 14 is secured with the clamp 12 as seen in FIGS. 2 and 3. The lever 82 of the actuating mechanism 64 is pushed inward toward the sidewall 78 in the cavity 80 of housings 60 and 62. As this occurs, the pin 100 follows in the vertical portion of the slots 70 in the housing members 60 and 62. The roller 90 moves upwardly and inwardly along the slot as it engages against at least one of the plates 30-36 of the toggle mechanism 18. As the roller 90 reaches the top of its stroke, the toggle mechanism 18 is pushed inward into its overcenter position locking the clamp 12 in a clamped position as seen in FIG. 3. The latch 66 web portion 102 is pushed downward to release the cut-outs 108 of legs 104 and 106 from the receiving pin 16. The handle 14 is then removed from the clamp 12, which is in a clamped position. In order to release the clamp 12, the release mechanism button 52 is pushed downward into gap 29. As this occurs, the tab 54 pushes against one of the plates 34, 36 releasing the toggle mechanism from its locked condition. The clamp 12 is moved into an opened condition and can be removed from the workpiece (see FIG. 4).

Figure 5:
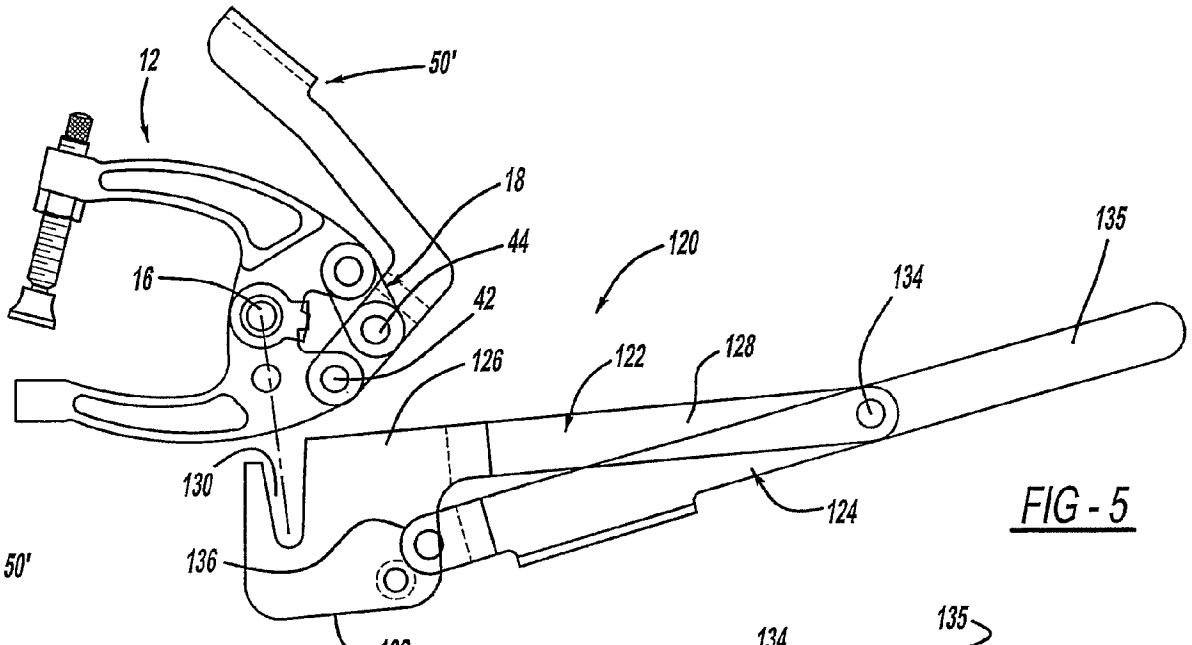
FIG. 5 is a side elevation view of a second embodiment of a clamp with removable handle.
Figure 6:
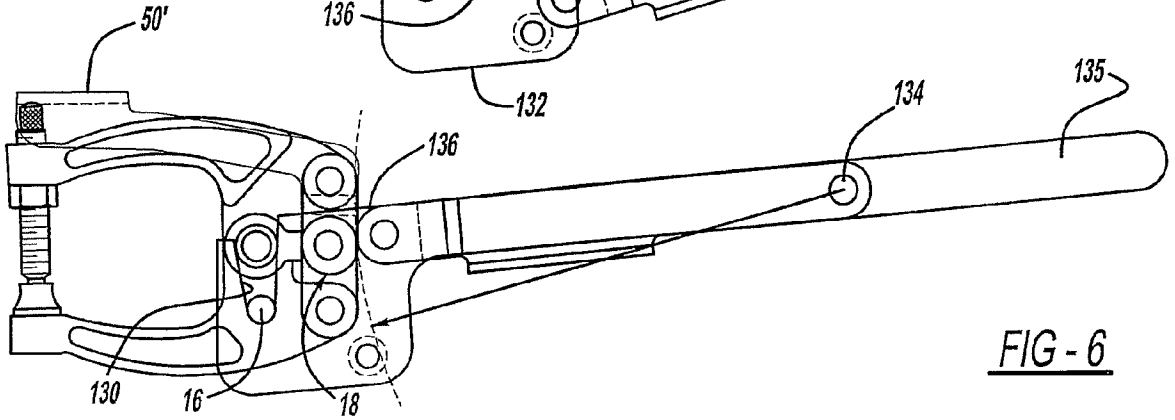
FIG. 6 is a view like FIG. 5 with the handle and clamp in an activated and clamped position.

Turning to FIGS. 5 and 6, an additional embodiment is illustrated. In FIGS. 5 and 6, the clamp 12 is substantially the same as that described above. The differences will be explained below.

The release mechanism 50' is secured to the pivot pin 42 as well as the pin 44 to release the clamp 12 from its clamped to its open position. The L-shaped release member 50' includes a slot associated with the pin 44 and an aperture receiving pin 42. The release member 50' pivots to move the clamp to an opened position.

The handle 120 includes a housing 122 and an activation member 124. The housing 122 includes a head 126 and a tail 128 extending from the head. The head 126 includes a cut-out slot 130 to mate with the pin 16. The housing 120 is bifurcated including identical sides panels connected by a web 132.

The activation member 124 is an elongated lever 135 pivotally secured at the tail 128, via a pin 134. The lever 135 includes a cam surface 136. The cut-out 130 is positioned onto the receiving pin 16. The activation member 124 enables the lever 135 to be pivoted about the pin 134. As this occurs, the cam surface 136 contacts the toggle mechanism 18 moving the clamp 12 from an opened to a clamped position as illustrated in FIGS. 5 and 6.

Figure 7:
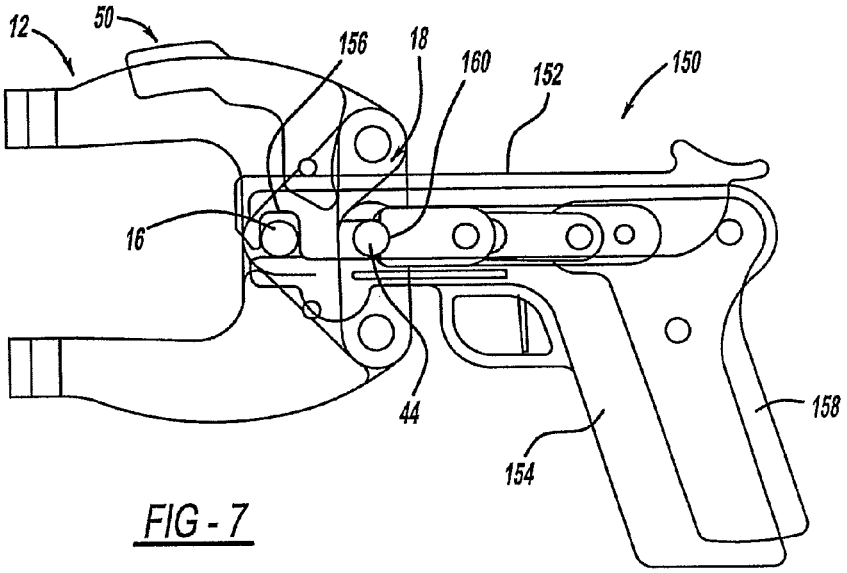
FIG. 7 is an elevation view of a third embodiment of the clamp and removable handle.

Moving to FIG. 7, an additional embodiment of the clamping mechanism is illustrated. The clamp 12 is substantially the same as those previously described.

The handle 150 has an overall pistol configuration. A latch 152 is positioned onto the top of the housing 154. The latch 152 is bifurcated having two sides connected by a web. The sides include a cut-out 156 that fits over the pin 16 like that previously described. The housing 154 includes an actuation member 158. The actuation member 158 pivots forcing a cam surface 160 to move axially against the pin 44 or plates of the toggle mechanism 18. As this occurs, the toggle mechanism 18 moves to its overcenter position. The release mechanism 50 is manipulated like that previously described to move the toggle mechanism 18 outward releasing the clamp to its open position.

Figure 8:
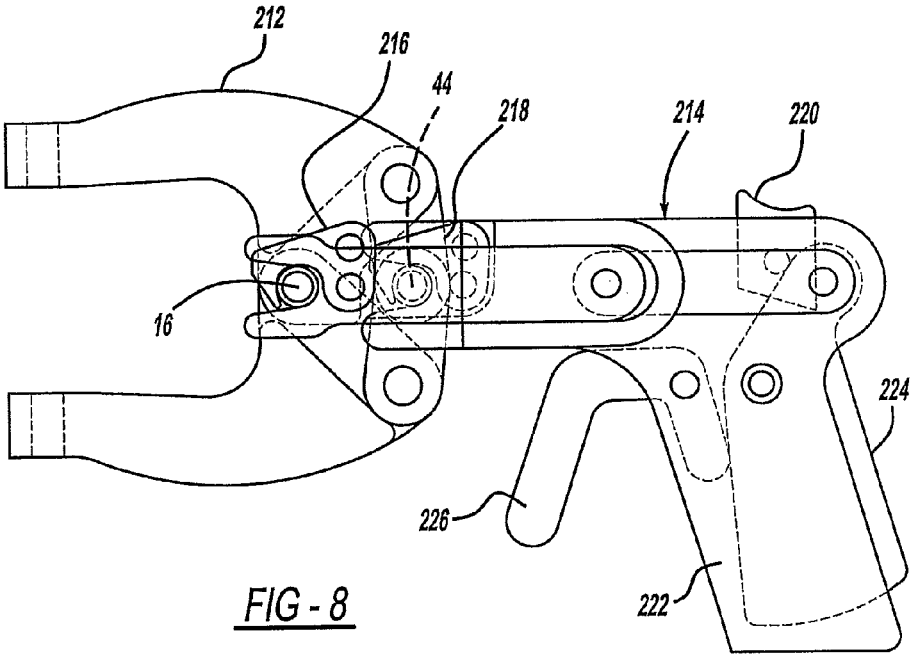
FIG. 8 is an elevation view of a fourth embodiment of the clamp with a removable handle.
Figure 9:
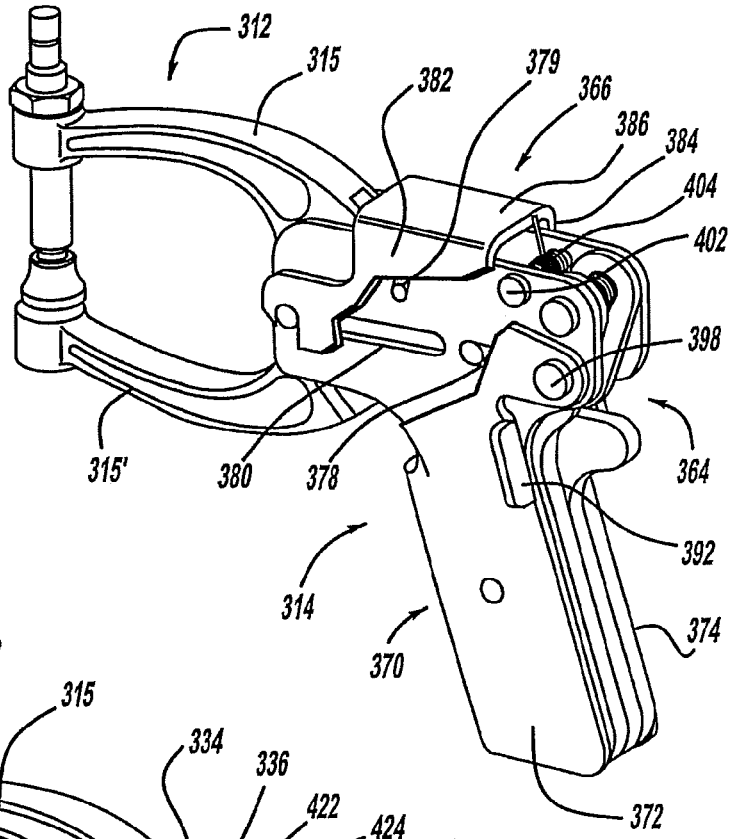
FIG. 9 is a side elevation view of a fifth embodiment of the clamp with a removable handle.

Turning to FIG. 8, an additional embodiment is illustrated. In FIG. 8, the clamp 212 is like those previously described except that it does not include a release mechanism. The arms and the toggle mechanism are like those previously defined.

The handle 214 has an overall pistol configuration. The handle 214 includes a pair of latch mechanism 216 and 218. The latch mechanism 216 secures with the receiving pin 16 while the latch mechanism 218 secures the pin 44 of the toggle mechanism 16. The push button 220 releases the latch mechanism 216, 218 from the pin 16 and 44, respectively. The handle 214 includes a housing 222 and an actuation member 224. The actuation member 224 is pushed inwardly so that the latch mechanism 218 is moved axially to push the toggle mechanism 18 inward into its overcenter locked position. As trigger 226 is activated, the pin 44, toggle mechanism 18 and latch 318 are moved rearwardly to release the clamp 212 from its clamped position into its opened position.

When the clamp is in an opened position, the push button 220 is activated so that both latches 216 and 218 are secured onto the pins 16 and 44, respectively. As the actuation member 224 is activated, latch 218 is pushed forward, the clamp 212 is locked in its clamped position. At that time, the push button 220 is activated releasing the latches 216 and 218 from the pins 16 and 44. Thus, at this time, the clamp is free standing. To release the clamp, the push button 220 is activated and the latches 216 and 218 are again secured around the pins 16 and 44, respectively. The trigger mechanism 226 is activated which moves the latch 218 away from the clamp 212 releasing the toggle mechanism 18 to enable the clamp to move into an opened position.

Turning to FIGS. 9-13, an additional embodiment is illustrated. The clamp is like that of FIG. 1 with the similar features designated with reference numerals increased by 300.

A clamp 312 includes a pair of arms 315, 315'. The arms 315, 315', unlike the arms of clamp 12, are solid. A pin 316 connects the arms 315 and 315' together at one end. A toggle mechanism 318 is secured by pins to the arms 315 and 315'. The toggle mechanism includes a pair of outer plates 330 and 332 and a pair of inner plates 334 and 336. The inner and outer plates are coupled together by a pin 344 that extends through the plate. The toggle mechanism 318 operates like toggle mechanism 18.

The releasable handle 314 includes an activation member 364 and a latch mechanism 366. The handle 314 includes an outer housing 370 that includes a pair of opposing sides 372 and 374. The sides 372, 374 are integrally connected to one another via a web 376 providing an U-shaped cross-section. The sides 372 and 374 are substantially identical and have an overall inverted L-shape. The top portion of the sides 372 and 374 each include a slot 378 that receives a pin of the activation member 364 as will be discussed later. Additionally, the housing sides 372 and 374 each include an open channel 380. The channel 380 enables axial linear movement of the pin 344 of the toggle mechanism 318. Thus, the toggle mechanism 318 can move the clamp 312 from an open to a closed position.

Figure 10:
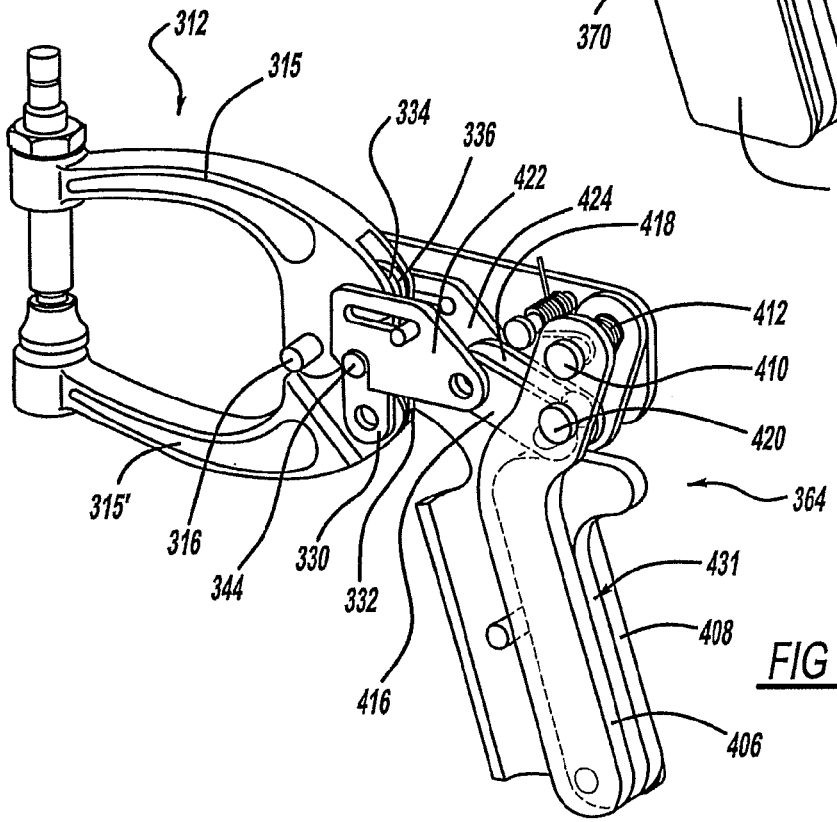
FIG. 10 is an elevation view in partial cross-section of FIG. 9.
Figure 11:
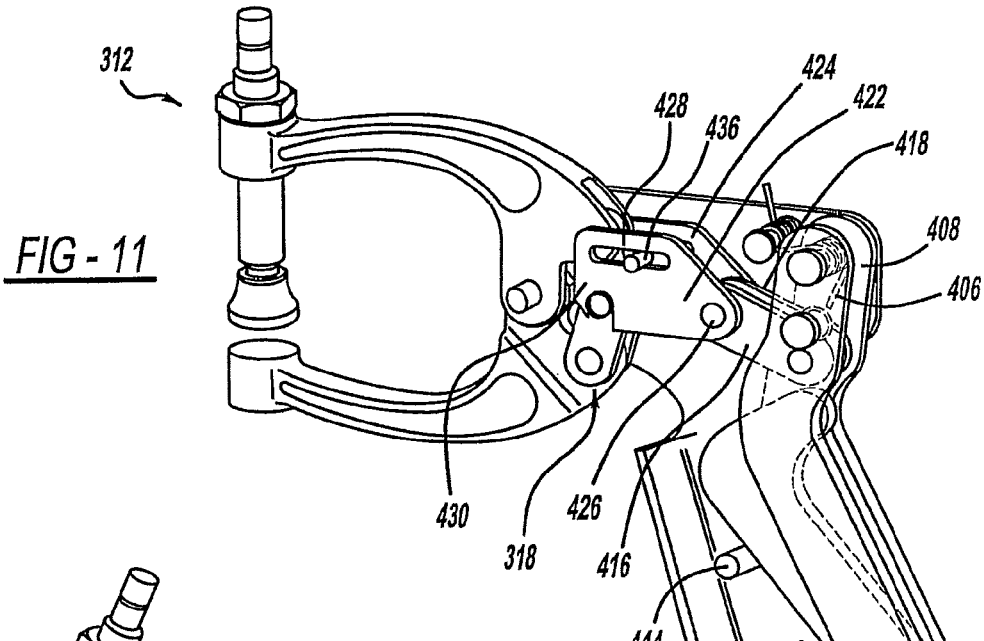
FIG. 11 is a view like FIG. 10 moving towards a clamp release position.

The latch mechanism 366 has an overall saddle shape with substantially identical sides 382 and 384 integrally connected via a web 386. The sides 382 and 384 each include a hook portion 388, an ear portion 390 and a push button portion 392. The hook portions 388 include a chamfered surface 394 that leads into a cutout 396. The chamfer portion 394 contacts the pin 316, as it is connected to the clamp 312, moving the latch mechanism 366 upward so that the pin 316 is retained in the cutout 396, as seen in FIG. 10. The ear portion 390 includes a pin 398 that extends through the housing sides 372 and 374. The pin 398 pivotally secures the latch mechanism 366 onto the handle housing 370. An additional pin 402 is secured onto the housing sides 372 and 374. A torsion spring 404 is positioned about the pin 402. The torsional spring 404 is coupled with the latch mechanism 366 so that when the push button 392 is moved forward, as in FIG. 13, the spring 404 returns the latch mechanism 366 back to its original down position as illustrated in FIG. 10.

The activation member 364 includes a pair of levers 406 and 408. The levers 406 and 408 are pivotally secured with the housing sides 372, 374 via pin 410. A spring 412 is positioned about pin 410. The spring 412 bias the lever members 406 and 408 between an open and a locked position. A pair of links 416 and 418 is connected to levers 406 and 408. The links 416, 418 are connected via pin 420 with the levers 406 and 408. The other end of the links 416 and 418 are pinned with a pair of latch members 422 and 424. The links 416 and 418 are pinned via pin 426 that extends through latch members 422 and 424 as well as links 416 and 418. The ends of the pin 426 slide in slots 378. Thus, the pin 426 enables substantially linear movement of the latch members 422 and 424 inside of the housing sides 372 and 374.

The latch members 422 and 424 each include slot 428 as well as a hook member 430. The hook members 430 include a chamfer 432 as well as a cutout 434. The chamfers 432 contact the pin 344 which lifts the latch member 422 and 424 upward so that ends of the pin 344 can be received in the cutouts 434. A pin 436 extends through the slots 428 of latch members 422 and 424. The pin 436 extends through slots 379 in sides 372 and 374 to terminate in the sides 382 and 384 of the latch member 366. Thus, as the latch member is pushed inward, via push buttons 392, as in FIG. 13, both the latch mechanism 366 as well as latch members 422 and 424, via pins 436 in slots 379, moves upward so that the handle 314 can be removed from the clamp 312.

A lever lock 431 is positioned in between the levers 406 and 408 for releasing the toggle mechanism 318 for opening and clamping the clamp 312. The lever lock 431 is pivotally secured to the levers 406 and 408 via pin 432. Thus, the lever lock 431 pivots with respect to the levers 406 and 408. Additionally, a pin 444 is positioned in between housing sides 372 and 374. The lever lock 440 also includes an extending tab 446.

Turning to FIGS. 9-13, an explanation of the operation of the removable clamp handle 314 will be discussed.

Figure 12:
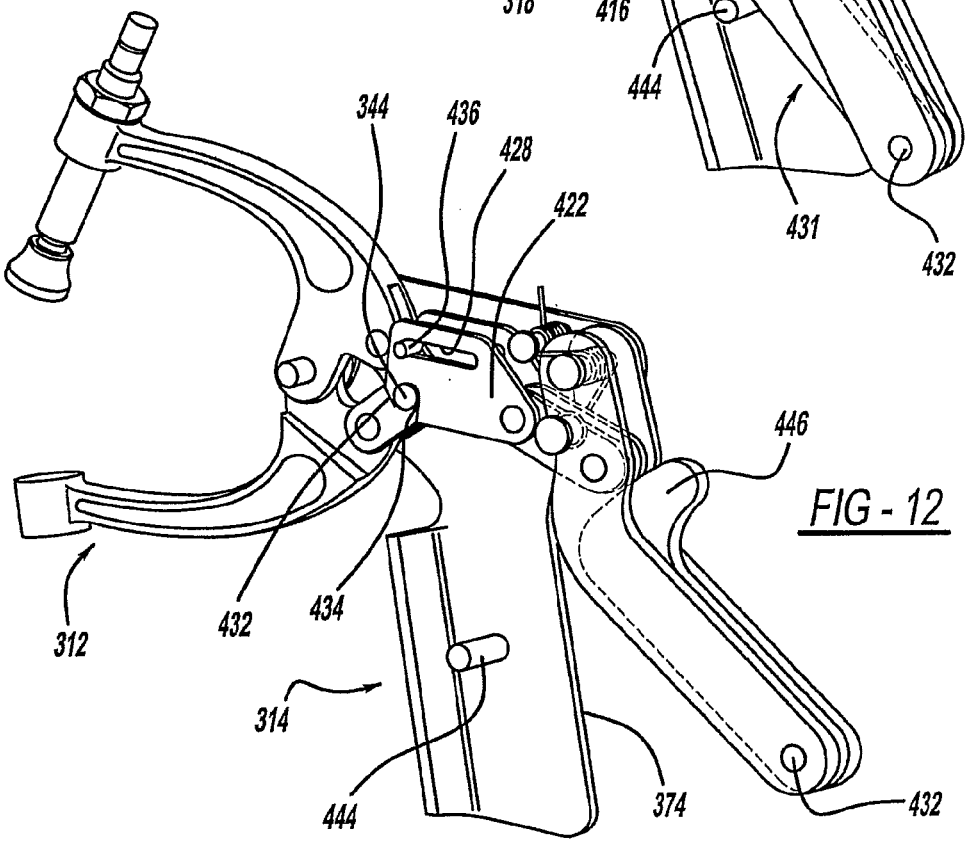
FIG. 12 is a view like FIG. 10 in a clamp release position.
Figure 13:
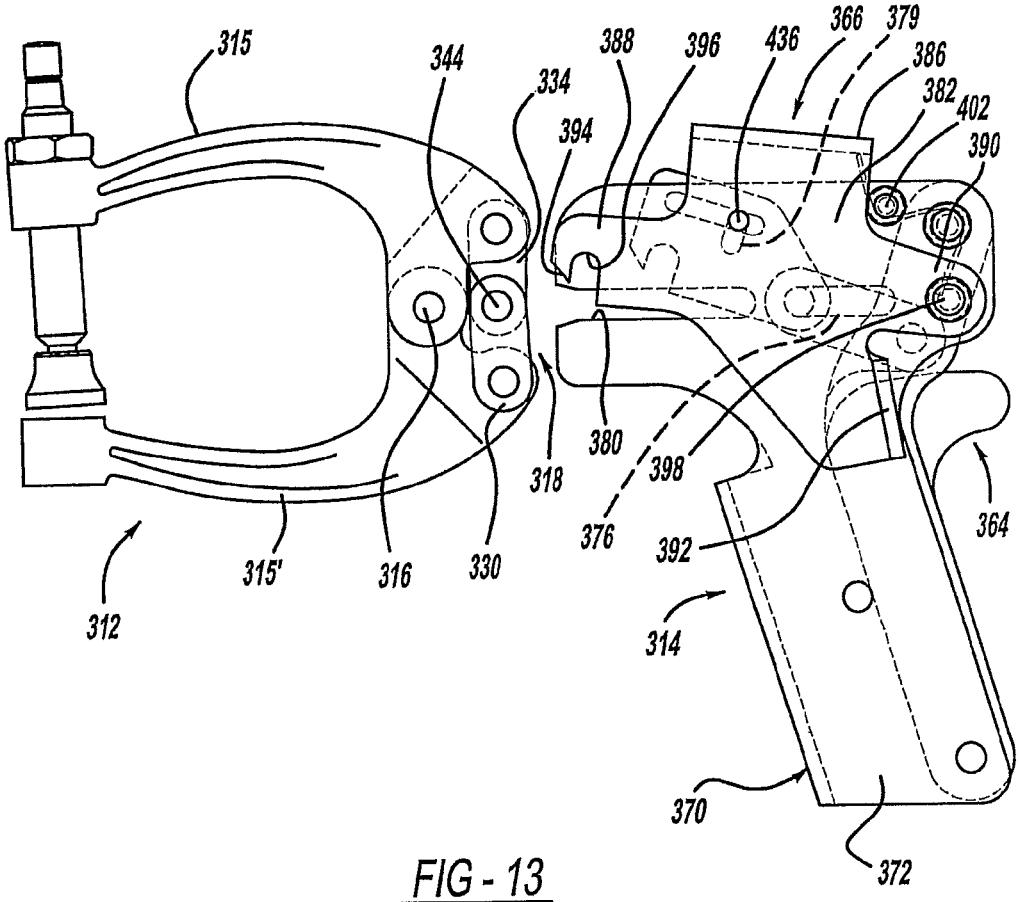
FIG. 13 is a side elevation view like FIG. 9 with the handle released from the clamp.

When the clamp 312 is in an open position, the handle 314 is secured onto the clamp 312. In order for this to occur, the activation member 364 has handles 406 and 408 projecting out from the housing 370 as illustrated in FIG. 12. The handles 406 and 408 are moved inward. As this occurs, the links 416 and 418, as well as the latch members 422 and 424, move linearly in the housing 370. The linear movement is provided by the pins 426 and 436 sliding in the slots 378 and 428, respectively. By moving in the slots, the latch members 422 and 424 move axially in the housing 370 until they contact the pin 344. As this occurs, the toggle mechanism 318 begins to move towards the arms 315'. As this happens, the latch mechanism 366, via the chamfers 394, rides up over the top of pin 316 and secures the latch mechanism 366 with the clamp 312. The arms 315 and 315' begin to move toward one another and clamp onto the workpiece, as illustrated in FIG. 12. As the levers 406 and 408 are moved forward, the links 416 and 418 pivot the levers around pin 410. As this occurs, the lever lock 440 contacts pin 444. The levers 406 and 408 are continued to be pushed inward against the bias of the spring 412. The lever lock 440, blocked by pin 444, pivots through the levers 406 and 408, as illustrated in FIG. 10. This causes an overcenter locking of the toggle mechanism 318. Thus, the clamp 312 is securely locked onto the workpiece. After this occurs, the latch mechanism 366 is pivoted around pivots 398, via the pushing of push buttons 392. As this occurs, the cutouts 396 and 434 release from pins 316 and 344, respectively, enabling the removable handle 314 to be removed from the clamp 312.

In order to remove the clamp from the workpiece, the removable handle 314 is moved into position such that open channels 380 align with pin 344 and pin 316. The handle 314 is pushed forward until the latch mechanism 366 as well as the latch members 422 and 424 move upward and then downward to capture the pins 316 and 344 in cutouts 434 and 396, respectively. Next, the lock lever 344 is pivoted inwardly into the housing 370 to release the toggle mechanism 318 from its overcenter locked position. As this occurs, the levers 406 and 408 begin to move away from the housing 370. The spring 412 biases the levers 406 and 408 to their outward released position illustrated in FIG. 12. As this occurs, the links 416, 418 and latch members 422, 424 move away from the clamp 312 drawing toggle pin 344 with them. This opens the clamp 312 so that it may be removed from the workpiece.

The description of the disclosure is merely exemplary in nature and thus, variations that do not depart from the gist of the disclosure are intended to be within the scope of the disclosure. Such variations are not to be regarded as a departure from the spirit and scope of the disclosure.

What is claimed is:

1. A clamping device with a removable handle comprising:

a C-clamp including a pair of arms pivotally connected with one another, a toggle mechanism mounted to the clamp for moving the arms between an opened and closed position, and a receiving pin projecting from the C-clamp for receiving a removable handle;

the removable handle coupling with the receiving pin for pivoting the arms from the opened to clamped position, the handle comprising a housing, a latch coupled with the housing for coupling the housing with the receiving pin, the latch movable between a coupled position, secured with the receiving pin, and a release position enabling removal of the housing from the receiving pin, a toggle activating member coupled with the housing, the toggle activating member including at least one latch member movable in said housing for engaging the toggle mechanism and moving the arms into the closed position; and a release element, the release element coupled with the C-clamp for engaging the toggle mechanism and moving the arms into the opened position wherein the release mechanism moves the toggle mechanism for moving the clamp from the clamped position into the opened position.

2. The clamping device with a removable handle of claim 1, wherein a lever is coupled with the at least one latch member.

3. The clamping device with a removable handle of claim 2, wherein the lever is biased with the removable handle.

4. A clamp comprising:

a pair of arms having two ends, one end of each arm connected together by a pivot mechanism, the pivot mechanism mounted on the pair of arms for enabling the arms to move with respect to one another between an opened and clamped position, a receiving member for receiving a handle is on at least one of said arms;

a handle for removably coupling with the receiving member, the handle including an activating mechanism including at least one latch member for engaging said pivot mechanism for moving the arms between the opened and clamped position; and a release mechanism coupled with the pivot mechanism for moving said arms between said clamped position and said open position wherein the release mechanism moves the pivot mechanism for moving the clamp from the clamped position into the opened position.

5. The clamp of claim 4, wherein the toggle activating mechanism includes a pair of latch members.

6. The clamp of claim 4, wherein a lever is coupled with the at least one latch member.

7. The clamp of claim 6, wherein the lever is biased with the removable handle.

8. The clamping device with a removable handle of claim 6, wherein the toggle activating mechanism includes a pair of latch members.

* * * * *